United States Patent [19]

Raz

[11] Patent Number: 4,504,041

[45] Date of Patent: Mar. 12, 1985

[54] WHEELED LIFTING APPARATUS

[75] Inventor: Dan Raz, Haifa, Israel

[73] Assignee: Electra Mikun (Industries) Ltd., Tel Aviv, Israel

[21] Appl. No.: 321,313

[22] Filed: Nov. 13, 1981

[30] Foreign Application Priority Data

| | | | |
|---|---|---|---|
| Nov. 14, 1980 | [IL] | Israel | 61482 |
| Jan. 8, 1981 | [IL] | Israel | 61881 |
| Aug. 17, 1981 | [IL] | Israel | 63585 |
| Aug. 17, 1981 | [IL] | Israel | 63586 |

[51] Int. Cl.[3] ..... B66F 3/22

[52] U.S. Cl. ..... 254/9 R; 254/122

[58] Field of Search ..... 254/9 R, 9 B, 9 C, 122, 254/124; 187/18; 182/69, 157, 158

[56] References Cited

U.S. PATENT DOCUMENTS

| | | | |
|---|---|---|---|
| 3,556,481 | 1/1971 | Mueller et al. | 254/122 |
| 4,180,252 | 12/1979 | Cushenbery | 254/122 |

*Primary Examiner*—Robert C. Watson

*Attorney, Agent, or Firm*—Browdy and Neimark

[57] ABSTRACT

Lifting apparatus and a wheeled vehicle upon which it can be mounted. There is provided in accordance with an embodiment of the present invention lifting apparatus comprising a scissors mechanism including scissor arms having formed thereon a curved cam path, a cam disposed between the scissor arms for engagement therewith and selectable separation thereof for producing lifting motion thereof, a load support mounted onto the scissor arms and apparatus for selectably tilting the load support with respect to the scissors mechanism. There is further provided in accordance with an embodiment of the present invention a wheeled vehicle comprising a base and a plurality of wheel assemblies supporting the base on a generally horizontal surface, at least one of the plurality of wheel assemblies comprising a castor assembly including a wheel rotatably mounted on a wheel mounting and apparatus for connecting the wheel mounting to the base and defining first and second axes of rotation, and preferably wherein at least one of the plurality of wheel assemblies comprises a steering wheel rotatably mounted onto a wheel mounting and steerable apparatus rotatably coupling the wheel mounting onto the base and permitting steering over at least 180° of arc.

9 Claims, 22 Drawing Figures

WHEELED LIFTING APPARATUS

FIELD OF THE INVENTION

The present invention relates to wheeled lifting apparatus and more particularly to lifting apparatus employing a scissors type mechanism comprising a steerable vehicle for moving a load on a generally horizontal surface.

BACKGROUND OF THE INVENTION

Many types of lifting apparatus employing a scissors mechanism are known. In most cases the scissors mechanism is operated by a hydraulic or pneumatic piston or by a screw drive or equivalent. These devices involve a difficulty in that a much greater amount of power is required at the beginning of the lifting operation than at the end thereof. As a result relatively large power capabilities must be provided, with attendant capital and operating costs.

Lifting devices are also known in which the scissors mechanism is operated by a cam which forces the scissors apart and wherein a curved cam path is provided on the scissors mechanism. Reference is made in this regard to German Pat. Nos. 604,156 and 1,175,852 which show such a structure. Reference is also made to U.S. Pat. No. 3,785,462 which shows a similar structure without a curved cam path.

Furthermore, many types of wheeled vehicles are known. One general type of such vehicle which is in common use in materials handling is commonly described as a dolly and is characterized in that at least some of its wheels comprise castors. For the purposes of this discussion, castors may be understood as comprising a wheel mounted on a mounting element, which element is in turn rotatably mounted about an axis which is non-intersecting with the axis of rotation of the wheel.

Dollies of the conventional type employing castors have a number of significant disadvantages. Most important among these is the difficulty in maneuvering the dolly, particularly when heavy loads are involved. This difficulty arises due to the tendency of castors to become locked in an orientation wherein they cannot roll in a desired direction. This tendency renders it nearly impossible in practice to move a conventional dolly back and forth along a straight line without spurious sideways travel.

Another significant disadvantage of conventional dollies is their relatively large turning radius. This characteristic limits the use of dollies in industrial and other applications and adds to space requirements in industrial plant design.

An additional disadvantage of conventional dollies is the relatively large amount of force required to move them to a desired location. As a result of the large force requirements, mechanized means must often be employed for maneuvering the dollies. Precise positioning of the dollies, which is required in many applications, is particularly difficult to achieve using mechanized apparatus. Furthermore, maneuvering conventional dollies normally requires both a pushing and a pulling capability.

An additional significant difficulty encountered with conventional dollies carrying heavy loads is wheel wear due to sliding motion of wheels during turning operations. The large amount of wear requires frequent wheel changes with resulting significant downtime of the equipment.

Castors are known having more than one axis of rotation. Reference is made in this connection to U.S. Pat. No. 1,797,830 which illustrates an automobile turntable employing such a castor and to U.S. Pat. No. 474,576 which illustrates such a castor designed to be attached to a furniture leg. The castors described in these references are all characterized in that they comprise a plate and roller assembly for vertically supporting the wheel. This arrangement greatly increases the frictional forces encountered in the operation of the castor and thus increases the force required for moving a load supported on the castor.

SUMMARY OF THE INVENTION

The present invention seeks to provide wheeled lifting apparatus which is relatively easy to operate and power efficient and which is capable of extremely precise orientation. The vehicle of the invention may be human powered in applications where previously mechanized power was required and may be precisely positioned with fewer required movements then was henceforth possible.

There is thus provided in accordance with an embodiment of the present invention lifting apparatus comprising a scissors mechanism including scissor arms having formed thereon a curved cam path, a cam disposed between the scissor arms for engagement therewith and selectable separation thereof for producing lifting motion thereof, a load support mounted onto the scissor arms and apparatus for selectably tilting the load support with respect to the scissors mechanism.

Further in accordance with an embodiment of the invention, the lifting apparatus comprises a pair of scissor arms which are jointed together.

Additionally in accordance with an embodiment of the present invention, only one of the scissor arms is provided with a cam and corresponding cam path.

According to an alternative embodiment of the invention each of the scissor arms is provided with a cam and corresponding cam path and means are provided for operating the cams in a differential mode.

Additionally in accordance with an embodiment of the present invention the cams comprise composite discs having portions which are rotatable relative to each other.

Further in accordance with an embodiment of the present invention means are provided for selectably governing the yaw, pitch and roll of the load support independently of the orientation of the scissor mechanism.

Additionally in accordance with an embodiment of the present invention the scissor arms are configured as channel members allowing a portion of the cams to be disposed therein and wherein the outer portions of the composite discs travel on the sides of the channel members, while the inner portions of the composite discs define pulleys which are engaged by tensioned cables.

Still further in accordance with an embodiment of the present invention, the means for operating the cams comprise cables which extend through the channel members, and means for applying tension to the cables.

Additionally in accordance with the invention, the means for applying tension to the cables comprise a crank and reducing gear means enabling operation of the lifting means under load under human power.

Further in accordance with an embodiment of the present invention, a fitting is associated with the crank for enabling it to be operated by a conventional power operated wrench, such as a pneumatic socket wrench.

Additionally in accordance with an embodiment of the invention the cam and cam paths formed on the scissor arms are constructed such that the amount of force required for operating the scissor mechanism load is substantially constant over the entire operating range of the mechanism.

Still further in accordance with an embodiment of the present invention, the lifting apparatus is mounted on a wheeled structure. The wheeled structure may define a cam path for permitting movement of the scissor arms relative thereto.

There is thus provided in accordance with an embodiment of the present invention a wheeled vehicle comprising a base and a plurality of wheel assemblies supporting the base on a generally horizontal surface, at least one of the plurality of wheel assemblies comprising a castor assembly including a wheel rotatably mounted on a wheel mounting and apparatus for connecting the wheel mounting to the base and defining first and second axes of rotation.

Additionally in accordance with an embodiment of the invention, at least one of the plurality of wheel assemblies comprises a steering wheel rotatably mounted onto a wheel mounting and steerable apparatus rotatably coupling the wheel mounting onto the base and permitting steering over at least 180° of arc. According to a preferred embodiment of the present invention steering is permitted over 270° of arc.

Additionally in accordance with an embodiment of the present invention the vehicle is provided with a pair of wheels having fixed axes of rotation disposed at a first end thereof, in addition to the castor assembly and the steering wheel, described hereinabove, disposed at an opposite end thereof.

Further in accordance with an embodiment of the present invention, the connecting apparatus of the castor assembly comprises a first element bearing mounted onto the base and extending along a first axis of rotation and a second element bearing mounted onto the wheel mounting and extending along a second axis of rotation, the first and second axes being parallel and offset from each other.

Additionally in accordance with an embodiment of the present invention the connecting apparatus is constructed so that no force connection is provided between the second element and the base along the second axis.

Further in accordance with a preferred embodiment of the present invention, the amount of offset between the first and second axes is selected with relation to the wheel diameter to require a minimum amount of force exertion for reorienting the castor assembly.

Still further in accordance with an embodiment of the present invention no steering connection is provided between the steering wheel and the wheel of the castor assembly for maintaining them in parallel orientation.

BRIEF DESCRIPTION OF THE DRAWINGS

The present invention will be more fully understood and appreciated from the following detailed description taken in conjunction with the drawings in which.

DETAILED DESCRIPTION OF THE INVENTION

Figure 1A:
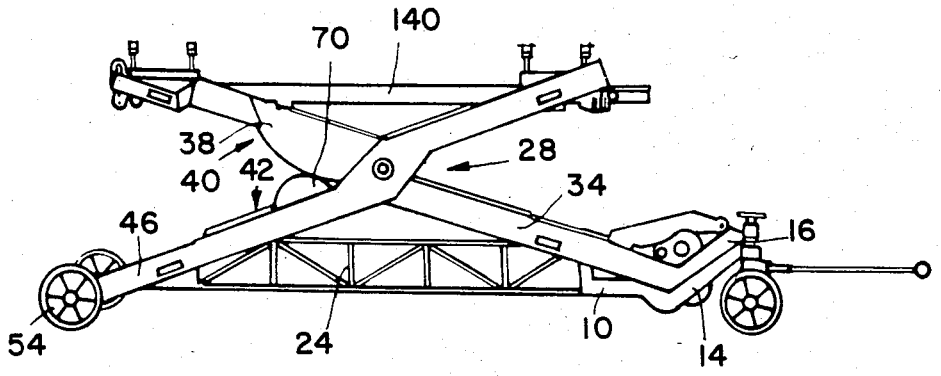
FIGS. 1A and 1B are pictorial illustrations of lifting apparatus constructed and operative in accordance with an embodiment of the present invention, seen from a first side of the apparatus when it is in a raised orientation.
Figure 1B:
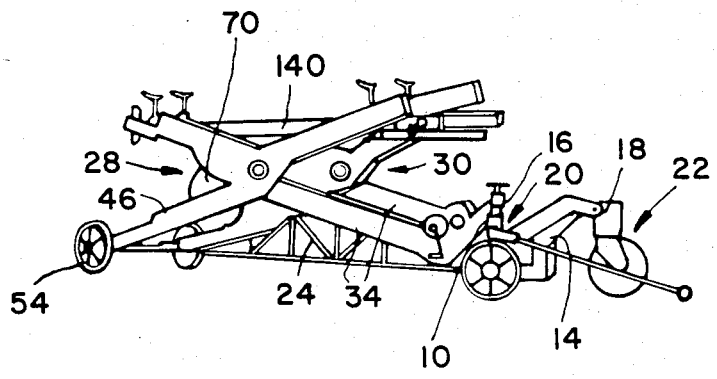

Reference is made to FIGS. 1A–4 which illustrate lifting apparatus constructed and operative in accordance with a preferred embodiment of the present invention. The lifting apparatus comprises a partial chassis 10 including a front transverse brace 12 having a pair of gooseneck extensions 14 extending upwardly and forwardly therefrom to respective support ends 16 and 18. Support end 16 is supported on a steering wheel assembly 20 which will be further described hereinbelow, and which provides an available turning range of 270° of arc and a braking mechanism. Support end 18 is supported on a castor assembly 22 which is also described hereinbelow, and which is characterized by extreme ease of turning motion provided by a two axis construction whereby substantially all of the forces are transmitted through both of the mutually offset axes.

Fixedly mounted onto one of the gooseneck extensions 14 is an elongate structural member 24, typically of lattice construction, which extends rearwardly of and in a generally perpendicular direction with respect to brace 12. Member 24 terminates in a mounting slit 26. It is a particular feature of the present invention that the lifting apparatus does not have a full chassis in the sense that all of the supporting wheels are maintained in a fixed relationship. In contrast to such a structure, and as will be described in detail hereinafter, the rear wheels of the lifting apparatus are not mounted directly onto chassis 10 but instead onto members whose position with respect to the chassis is permitted to change and is accomodated by mounting slit 26.

Hingedly mounted onto each of gooseneck extensions 14 adjacent respective support ends 16 and 18 are first and second scissor assemblies 28 and 30. Each of scissor assemblies 28 and 30 comprises a forward leg portion 32, which is pivotably connected onto the gooseneck extension 14, a generally straight main forward portion 34, which extends from the leg portion 32 to a pivot location 36 and a rear portion 38, all defining a first scissor element 40.

A second scissor element 42 cooperates with scissor element 40 and comprises a generally straight rear portion 46 which extends to pivot location 36 and a main forward portion 47 which extends forwardly of the pivot location. A forward support arm portion 48 is pivotably mounted about an axis 50 defined in portion 47 and is selectably retained in a raised orientation by means of a removable retaining pin 52. Removal of this pin allows arm portion 48 to assume a lowered orientation.

Figure 6:
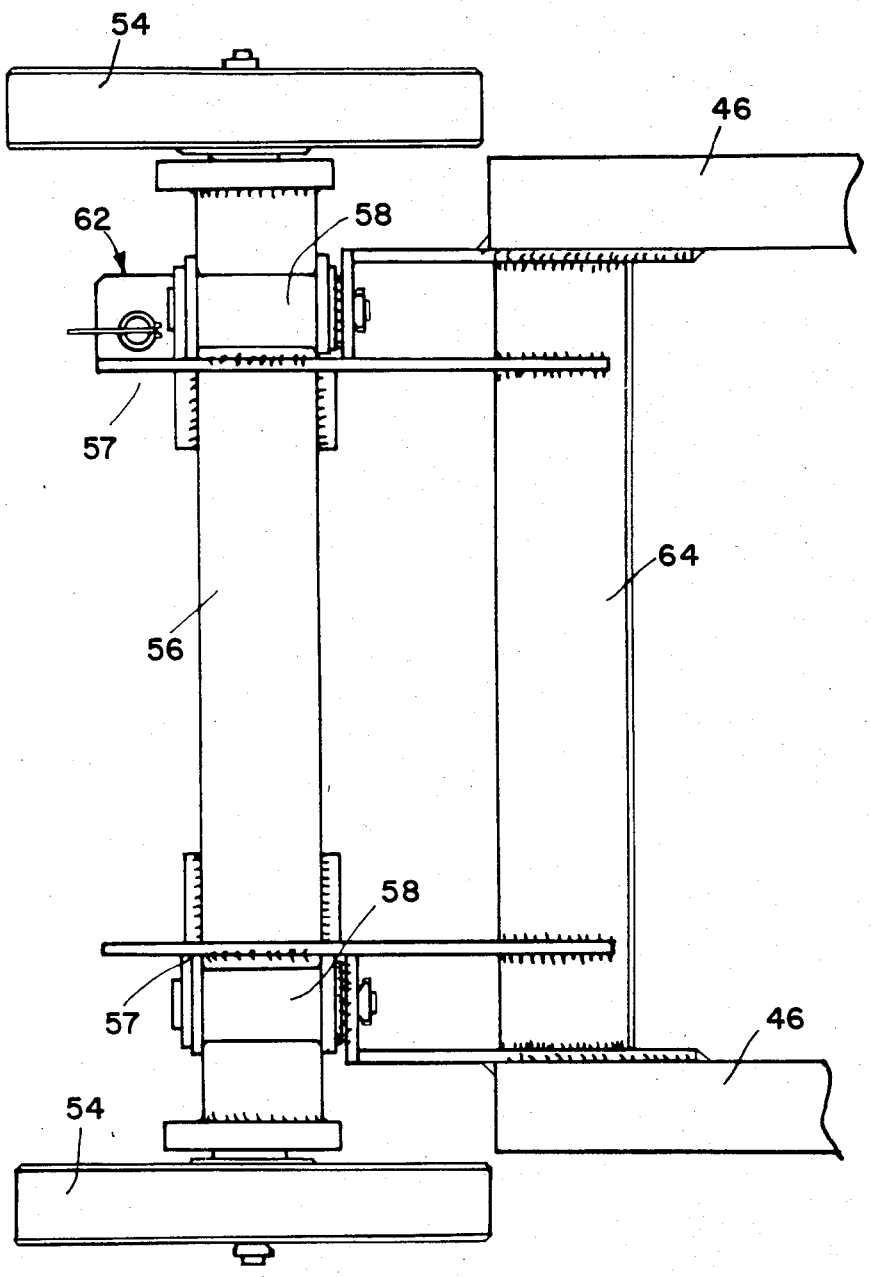
FIG. 6 is a top view illustration of the rear portion of the lifting apparatus.
Figure 7:
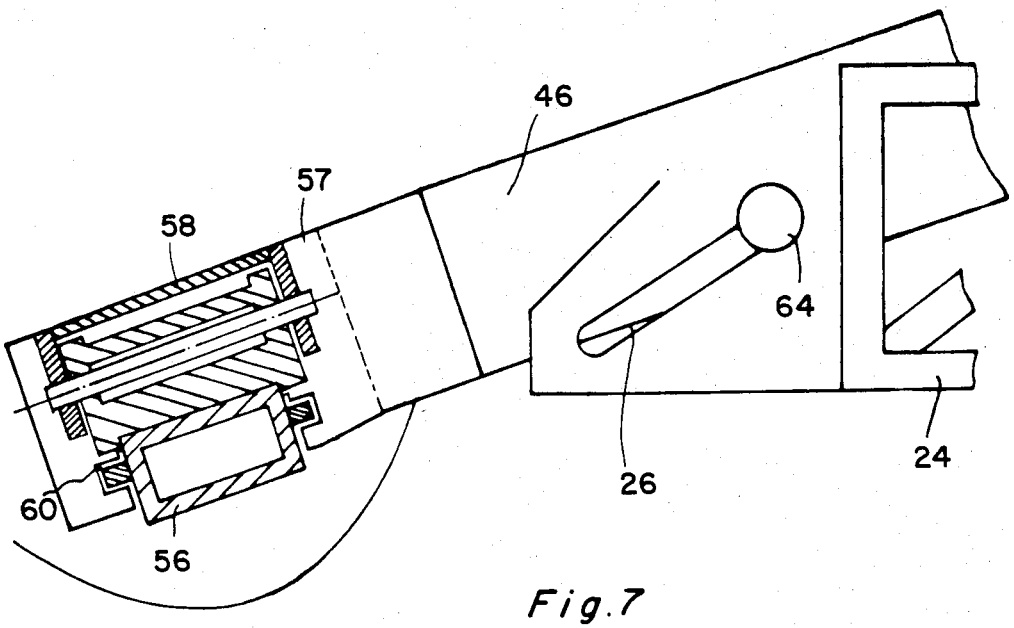
FIG. 7 is a side view illustration of the rear portion of the lifting apparatus.

A pair of rear wheels 54 are rotatably mounted onto an axle 56, which in turn supports the respective rear portions 46 of the second scissor elements. The engagement of rear portions 46 with axle 56 constitutes a particular feature of the present invention and is illustrated in FIGS. 6 and 7. Mounted onto an extension 57 of each of rear portions 46 is a roller 58. Extension 57 is also provided with slits 60 for accomodating axle 56 such that rear portions 46 are supported thereon by rollers 58 in slidable engagement along the axis of the axle 56. It may be appreciated, therefore, that the entire scissors assemblies 28 and 30 and indeed the entire lifting device with the exception of the rear wheels 54 may be selectably and easily shifted transversely relative to the axle 56. This enables fine sideways adjustments, as are often required in loading applications, to be carried out with relative ease and without reorienting of the entire chassis on its wheels.

A retaining pin assembly 62 is provided for retaining the rear portions 46 in fixed engagement with axle 56, as during movement of the entire lifting apparatus. A crossbar 64 is fixedly attached between the two rear portions 46 for maintaining them in parallel alignment.

FIG. 7 also illustrates in detail the engagement of rear portion 46 with mounting slit 26 of member 24 by means of a supporting pin 64. It is appreciated that the position of pin 64 in slot 26 is determined by the angled orientation of rear portion 46.

It is appreciated that the apparatus shown in FIGS. 6 and 7 enables the yaw of the loading platform to be readily controlled. The ease with which the scissor elements may be slid with respect to axle 56 is due also to the provision of the castor assembly 22 which must adjust its position in accordance with a shift in the position of the scissors assemblies with respect to the rear wheels 54. It is noted that normally the steering wheel assembly 20 remains stationary.

A particular feature of the present invention is the mechanism for selectably operating the scissors assemblies 28 and 30 for raising and lowering thereof. This mechanism will now be described in detail. Generally speaking, the scissors assemblies 28 and 30 are operated by means of a cam in the form of a disk 70 which is disposed between respective first and second scissors elements 40 and 42. Movement of disk 70 towards pivot location 36 causes the elements 40 and 42 to spread apart, while movement of the disk 70 away from pivot location 36 allows the elements 40 and 42 to move together.

Figure 8A:
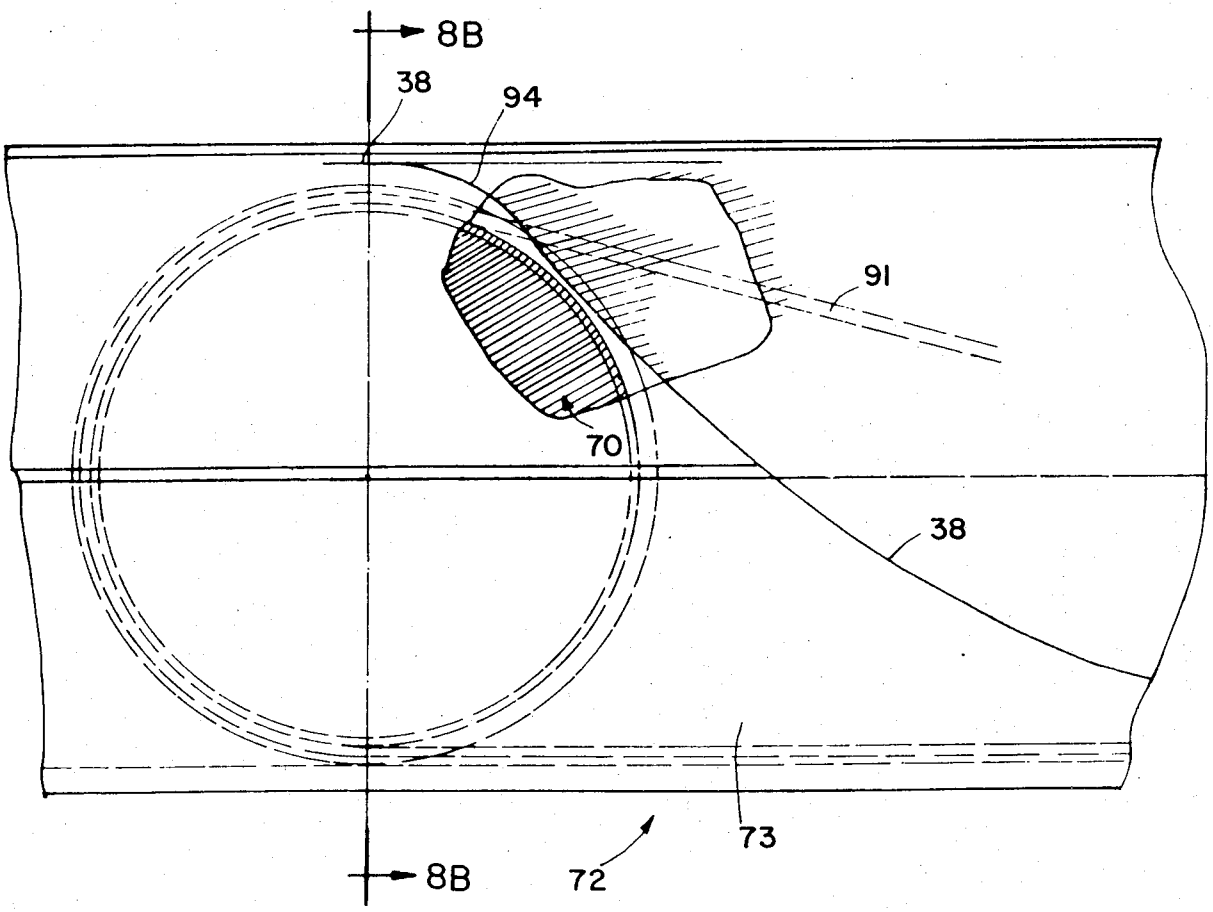
FIGS. 8A and 8B are respective side and sectional views of the cam disk mounted in the lifting apparatus.
Figure 8B:
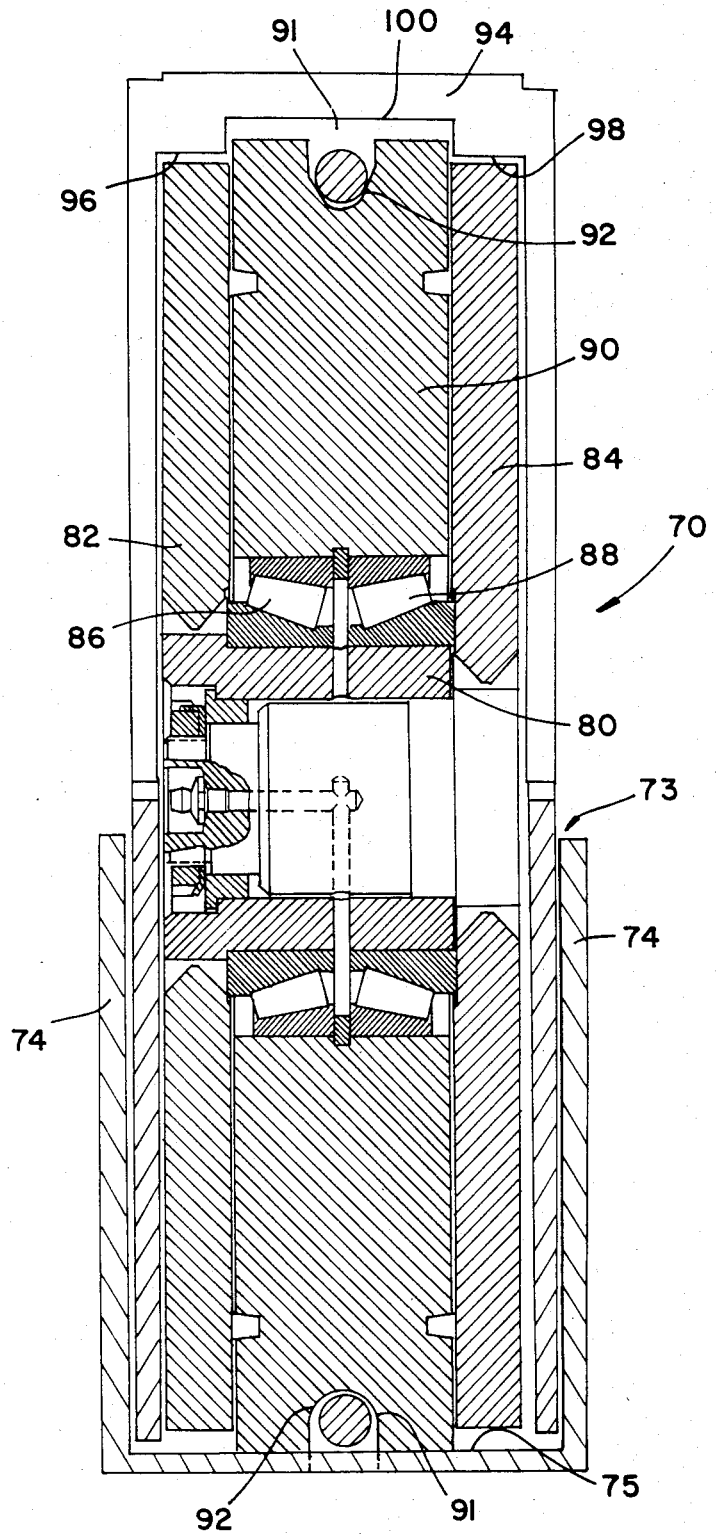

Reference is now made to FIGS. 8A and 8B which illustrate details of construction of the cam assembly. Rear portions 46 of the scissors assemblies include an intermediate portion 72 which defines an elongate slot 73 including upstanding support walls 74 and a bottom portion 75. As will be described hereinafter in greater detail, disk 70 is partially seated within slot 73. Rear portion 38 of first scissors element 40 is formed with a curved cam portion 76 adjacent the pivot location 36 at which the two scissors elements are joined and a slot portion 78 located rearwardly of cam portion 76 for accomodation a portion of disk 70 when the scissors assemblies are in a lowered orientation. It is appreciated that the provision of a slot in rear portion 38 enables the lifting apparatus of the invention to define an extremely low profile when in a lowered orientation. This feature is particularly important in aircraft loading applications.

The provision of cam portion 76 and its precise curvature are designed to provide optimized performance characteristics for the lifting apparatus such that the amount of force required to raise the scissors assemblies is substantially constant along the entire lifting range thereof. This feature is desired since it enables a power source, such as a motor, to be precisely matched to the requirements of the lifting apparatus and without providing costly excess capacity as occurs in the prior art. It is also appreciated that where, as in the present invention, the apparatus is designed to be human powered, the elimination of peak power requirements at particular portions of the lifting cycle of the apparatus, which occur in prior art apparatus, enable the apparatus to be operated conveniently under human power.

FIGS. 8A and 8B additionally illustrate the structure of disk 70 in sectional illustration and also show its operating relationship with respective rear portions 38 and 46. Disk 70 comprises a central hub 80 onto which are fixedly mounted first and second side flanges 82 and 84. Disposed intermediate flanges 82 and 84 and bearing mounted onto hub 80 by means of a pair of tapered bearings 86 and 88 there is provided an annular disk 90 which is formed with a peripheral groove 92 for accomodating a cable 91. It is appreciated that disk 90 is relatively freely rotatable with respect to side flanges 82 and 84.

It can be seen from FIG. 8B that rear portion 38 defines a bifurcated cam surface 94 having side upstanding portions 96 and 98 and an intermediate recessed portion 100. This arrangement is provided such that side flanges 82 and 84 engage upstanding portions 96 and 98 in supporting engagement, while intermediate recessed portion 100 does not engage annular disk 90 so as not to interfere with the relatively free rotation thereof. It is noted that the separation between upstanding support walls 74 of the slot defined by rear portion 46 is sufficient to accomodate rear portion 38 therebetween. It is also noted that since the interior bottom portion 75 of the slot defined in rear portion 46 is flat, annular disk 90 engages the slot in supporting engagement and is not freely rotatable with respect thereto when a load is applied thereto. Side flanges 82 and 84 are, however, freely rotatable with respect to rear portion 46. The operative result is that when motion of disk 90 is induced by movement of a cable 91 in engagement therewith, rolling motion of the disk 90 in engagement with rear portion 46 is produced.

Figure 4:
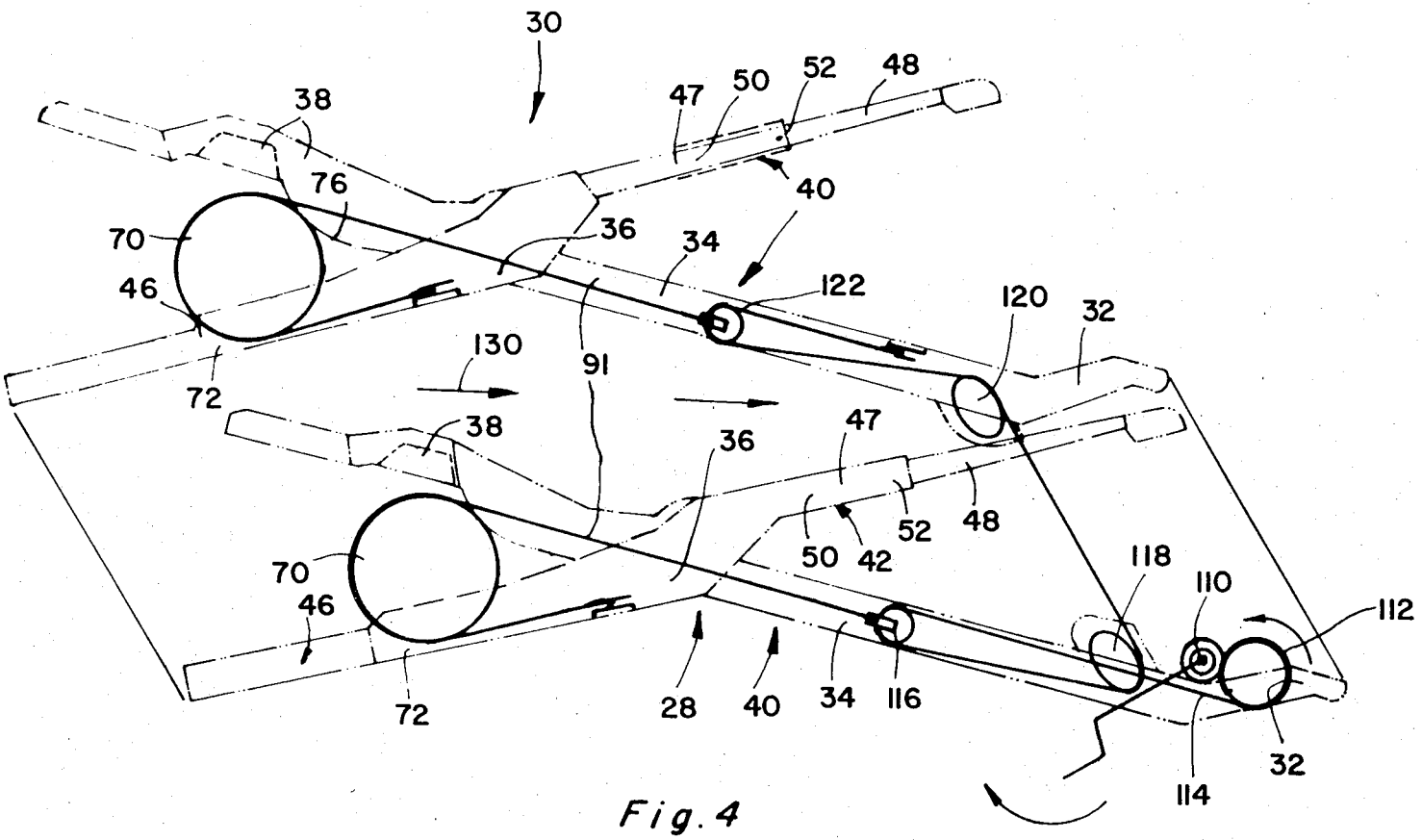
FIG. 4 is an illustration of the cable connections of the primary lifting mechanism of the lifting apparatus of the invention.

Reference is now made to FIG. 4 which illustrates the cable connections which interconnect disks 70 of the two scissor assemblies for coordinated operation thereof. A crank 110, which is arranged for either manual or power assisted operation, is coupled by suitable gearing to a first wheel 112 onto which is wound a primary cable 114. Primary cable 114 extends from first wheel 112 into engagement with a first free pulley 116 and thence via first and second fixed corner pulleys 118 and 120 into engagement with a second free pulley 122. Primary cable 114 terminates at a fixed location in forward portion 34 of scissors assembly 30.

As seen in the illustration respective first free and fixed pulleys 116 and 118 are mounted on forward portion 34 of scissors assembly 28, while respective second free and fixed pulleys 122 and 120 are mounted on forward portion 34 of scissors assembly 30. More precisely free pulleys 116 and 122 are located within the respective forward portions, while fixed pulleys 118 and 120 are located interiorly of the junction between the respective forward portions and transverse brace 12. It is thus appreciated that all of the extent of the primary cable 114 is interior and not exposed to operators.

Attached to each of free pulleys 116 and 122 there is a secondary cable 91 which extends rearwardly thereof and in engagement with groove 92 of disk 70 and terminates at a fixed location in rear portion 46 of the corresponding scissors assembly. The operation of the cable assembly will now be described briefly with reference to FIGS. 4 and 8B: Operation of the crank 110, typically in a clockwise direction causes the primary cable to wind onto first wheel 112, with the result that its effective length is shortened. This shortening causes free pulleys 116 and 122 to be pulled forwardly towards fixed pulleys 118 and 120. The forward movement of free pulleys 116 and 122 causes secondary cables 91 to be pulled forward with the result that interior disks 90 are rolled forward with respect to rear portions 46 in a direction indicated by arrows 130. The forward motion of interior disks 90 causes side flanges 82 and 84 to roll forwardly with respect to side upstanding portions 96 and 98. The forward motion of disks 70 in engagement with the curved cam surface causes the first and second elements of the scissors arrangement to spread as a predetermined function of the shortening of the effective length of the primary cable 114, such that the lifting apparatus is raised in response to a substantially uniform amount of force exerted at the crank.

It is appreciated that the particular arrangement of the primary and secondary cables produces a uniform amount of force on both disks 70 associated with the two scissors assemblies.

Figure 5:
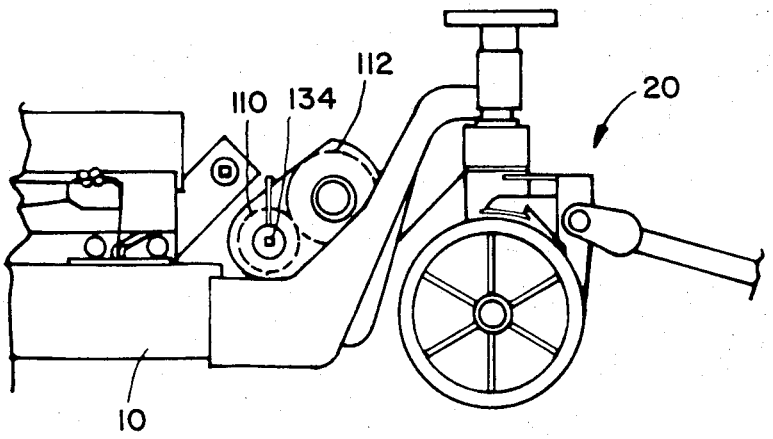
FIG. 5 is a side view illustration of the front portion of the lifting apparatus.
Figure 2A:
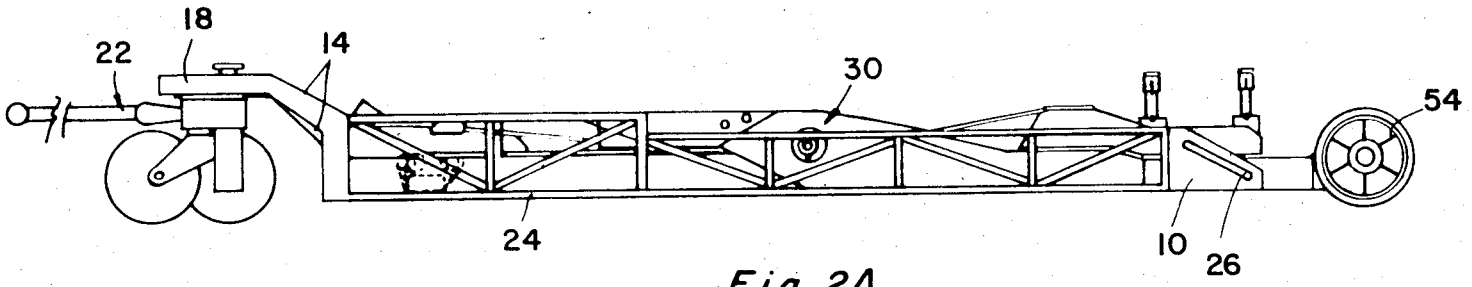
FIGS. 2A and 2B are side view illustrations taken on a second side of the apparatus of FIGS. 1A and 1B in respective lowered and partially raised orientations.
Figure 2B:
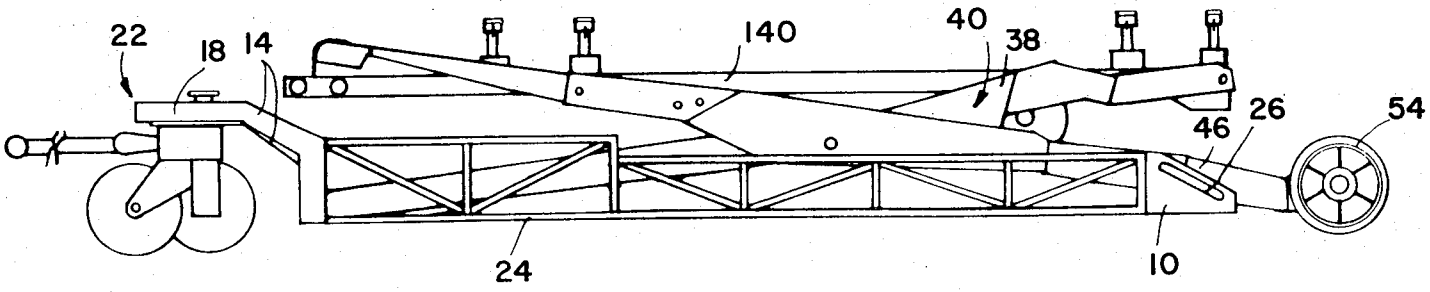

Reference is made briefly to FIG. 5 which illustrates the side forward portion of the crank 110 and indicates that the crank comprises a socket 134 which can be alternatively engaged by a hand crank or by a powered tool such as a pneumatically driven wrench, for example.

In the preceding description, the main lifting mechanism of the lifting apparatus has been described in detail. Attention is now directed to a number of subsidiary mechanisms which enable precise orientation of a load mounted onto the lifting apparatus of the present invention. These subsidiary mechanisms relate to the mounting of a load support frame 140 onto forward support arm portions 48 of scissor elements 42 at the forward portion of the lifting apparatus and onto rear portions 38 of scissor elements 40 at the rear portion of the lifting apparatus.

Figure 3:
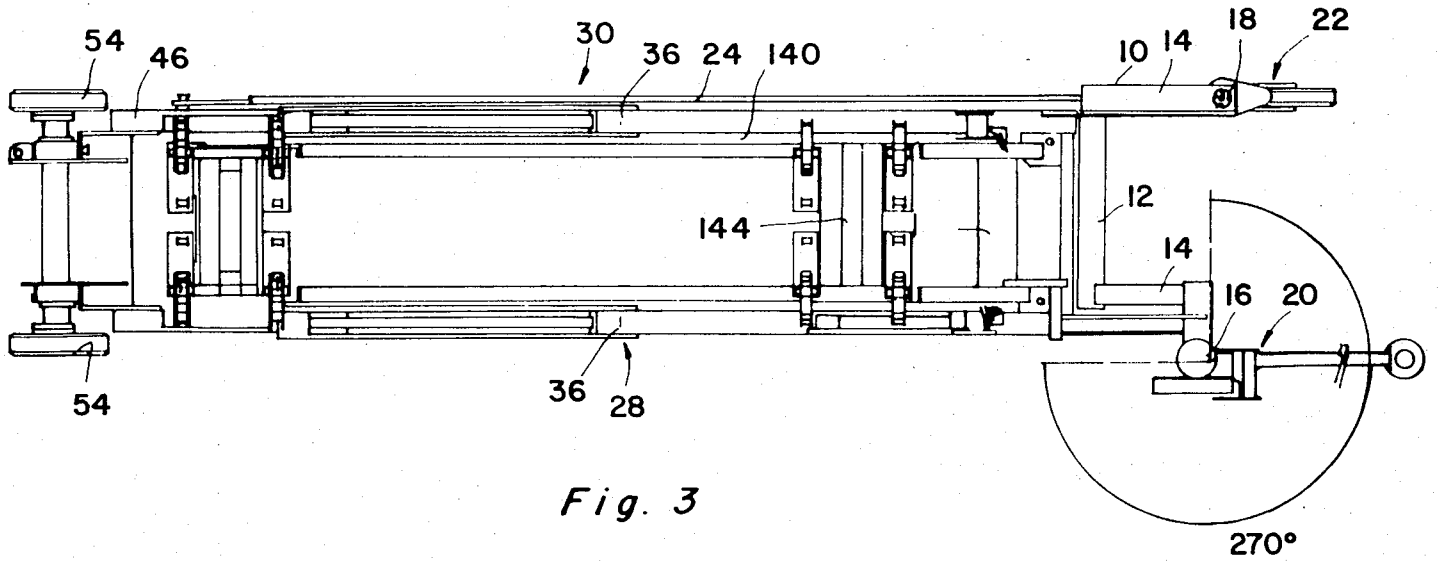
FIG. 3 is a top view illustration of the apparatus of FIG. 1 in a lowered orientation.

As seen in FIGS. 1A, 1B, 9 and 10D, load support frame 140 comprises a generally rectangular flat frame having first and second elongate side rails 142 interconnected by a plurality of transverse support members 144 (see FIG. 3). Load support frame 140 is mounted at the front thereof onto a forward undercarriage 146 and at the rear thereof by means of a pair of apertured upstanding plates 148, whose function will be described hereinafter. Forward undercarriage 146 comprises two pairs of rollers 150, each pair engaging an underside surface 152 of a rail 142 in supporting engagement, thereby permitting load support frame 140 to be slidably positioned at its front end onto the scissor assemblies, in order to compensate for changes in the distance between extreme front and rear ends of the scissor assemblies as a result of differences in the height thereof.

Forward undercarriage 146 is mounted onto forward support arm portions 48 by means of a cable assembly 160 which is illustrated in detail in FIGS. 10A–10D. The cable assembly comprises first and second cables 162 and 164, each of which is fixed at one end thereof onto a forward support arm portion 48 of a scissor assembly. Cable 162 extends from a forward support arm portion and over a pulley 168 which is mounted onto forward undercarriage 146 for rotation about a horizontal axis. Cable 162 extends from pulley 168 over a second pulley 170 which is mounted within undercarriage 146 for rotation about a vertical axis 172 and is fixed at its second end onto a mounting block 174.

Cable 164 extends from a forward support arm portion identified here by reference numeral 176 and over a pulley 178 which is mounted onto forward undercarriage 146 for rotation about a horizontal axis. Cable 164 extends from pulley 178 into tangential engagement with pulley 170 and is also fixed onto mounting block 174.

Mounting block 174 is threadably mounted onto a rotatable threaded shaft 180 which is bearing mounted onto undercarriage 146. A crank 182, which may be actuated by a hand crank or alternatively by a power assisted tool such as a pneumatic wrench, is coupled via a chain link 184 to a gear 186 coupled to shaft 180. Rotation of shaft 180 produces a sideways displacement of mounting block 174. It may be appreciated that movement of mounting block 174 to the right, in the sense of FIGS. 10A and 10B produces a raising of the undercarriage 146, while movement of mounting block 174 to the left produces a lowering of the undercarriage.

It may be appreciated that by suitable operation of crank 182, the pitch of the load support frame 140 may be readily determined. As noted above, the slidable engagement of the scissors assemblies with respect to axle 56 provides selectable yaw control.

Figure 9:
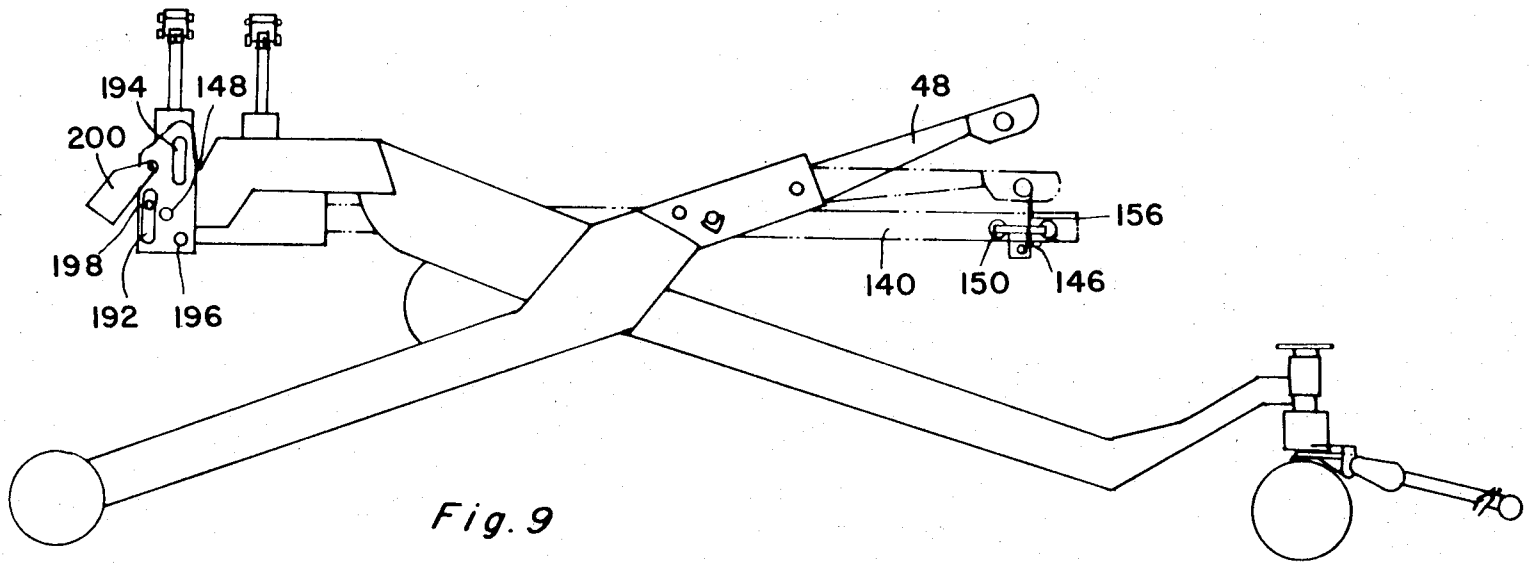
FIG. 9 is a side view illustration of the lifting apparatus illustrating the selectable positioning of a load carrier forming part thereof.
Figure 10A:
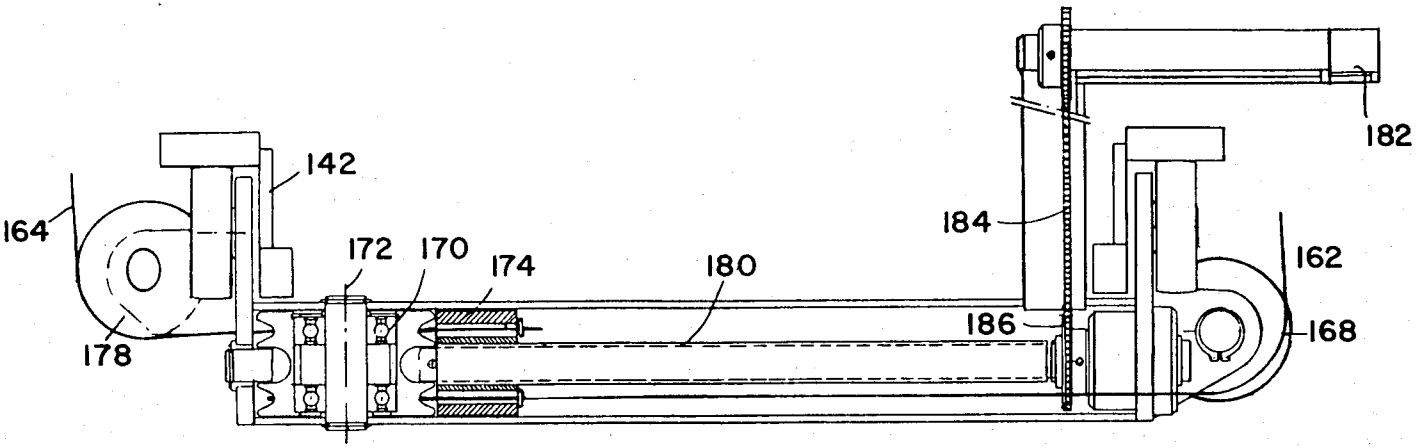
FIGS. 10A, 10B, 10C and 10D are respective end, top, end and side views of apparatus for selectable positioning of the front of the load carrier.
Figure 10B:
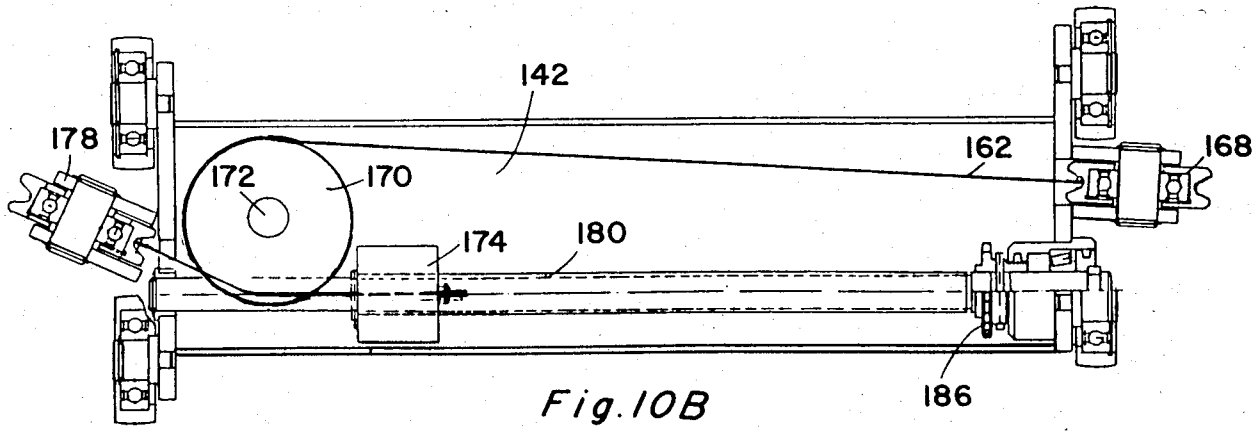
Figure 10C:
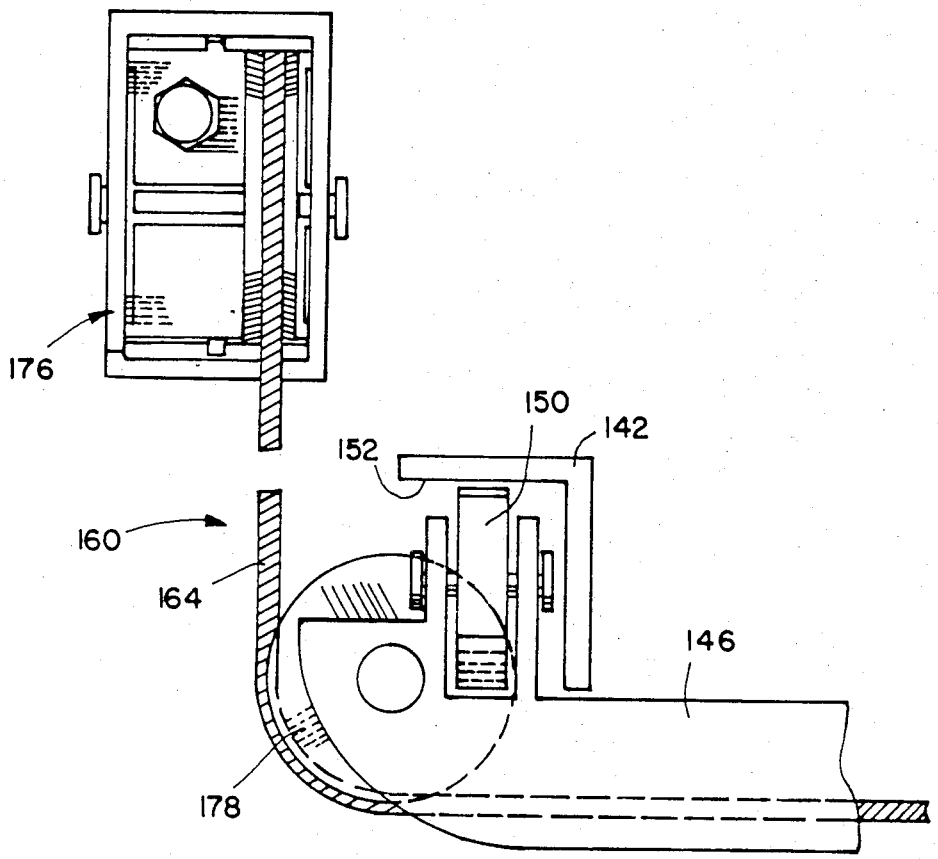
Figure 10D:
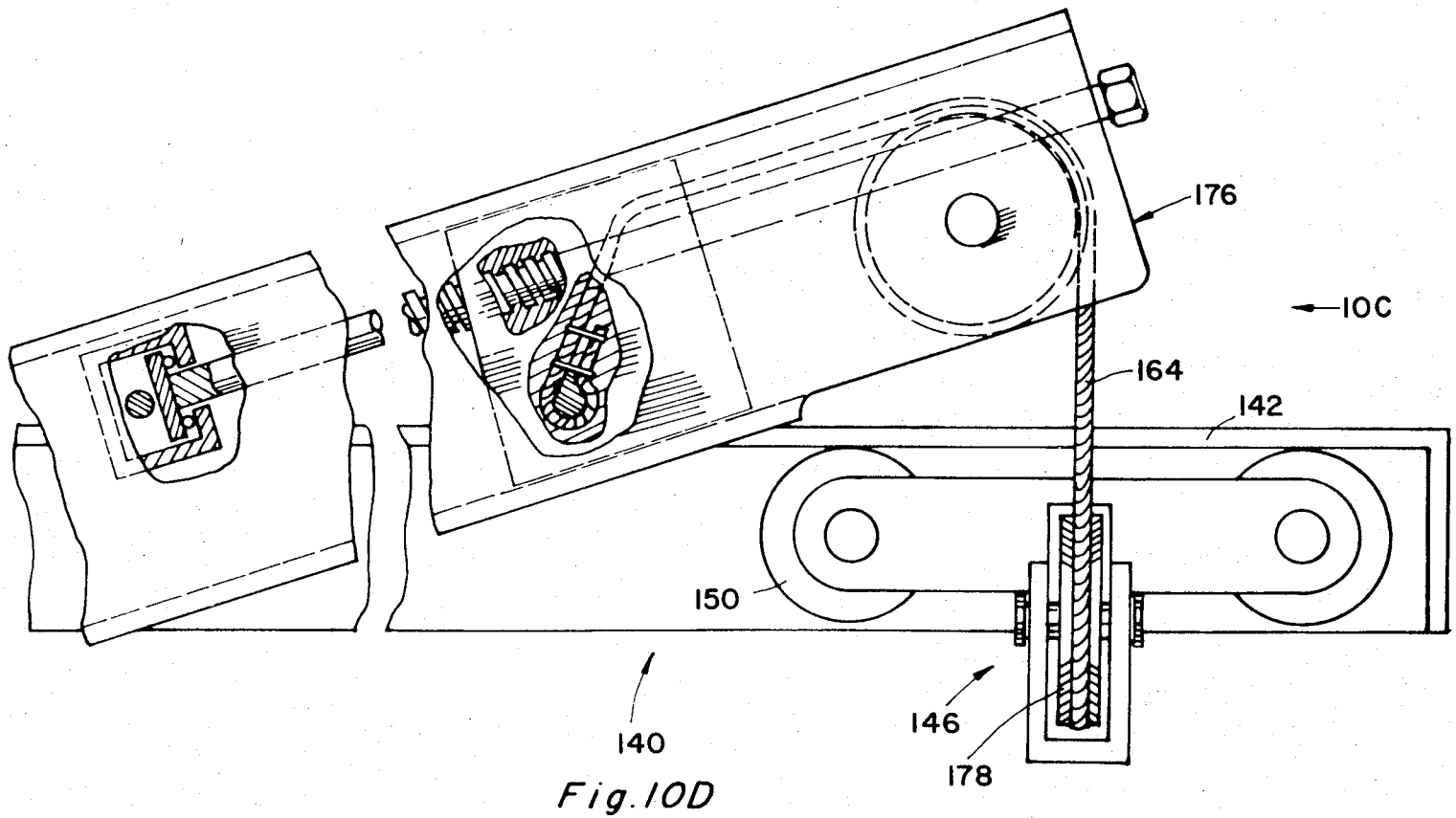

Apparatus for controlling the roll of the load support frame will now be described in connection with FIG. 9. As noted hereinabove, load support frame 140 is formed at the rear end thereof with a pair of upstanding plates 148, each having formed therein a pair of vertically oriented mounting slots 192 and 194 and a plurality of mounting apertures 196. A pin 198, which is attached to each of rear portions 38 is selectably engaged with a desired one of the mounting apertures or slots to determine the mounting height of the load support frame 140 relative to a given one of the scissors assemblies. Mounting slot 192 is provided with a hinged cover piece 200 which selectably and rotatably converts the slot to an aperture by covering the majority of the slot. Mounting slot 192 is employed when it is desired to provide a side-to-side tilt to the load support frame 140, as is required for certain loading applications. In such a case, on one side of the load support frame, the cover piece 200 is engaged with the slot, thus preventing the lowering of that side of the load support frame, while at the same time the cover piece 200 of the other slot 192 is disengaged with the slot, permitting corresponding pin 198 to move upwardly with respect to the load support frame 140 and providing a downward tilt.

Where the rear portion of the load support frame 140 is provided with such a side to side tilt, forward support arm portion 48 is also lowered on the corresponding lower side of the support frame 140, in order to provide a uniform sideways tilt.

Figure 11A:
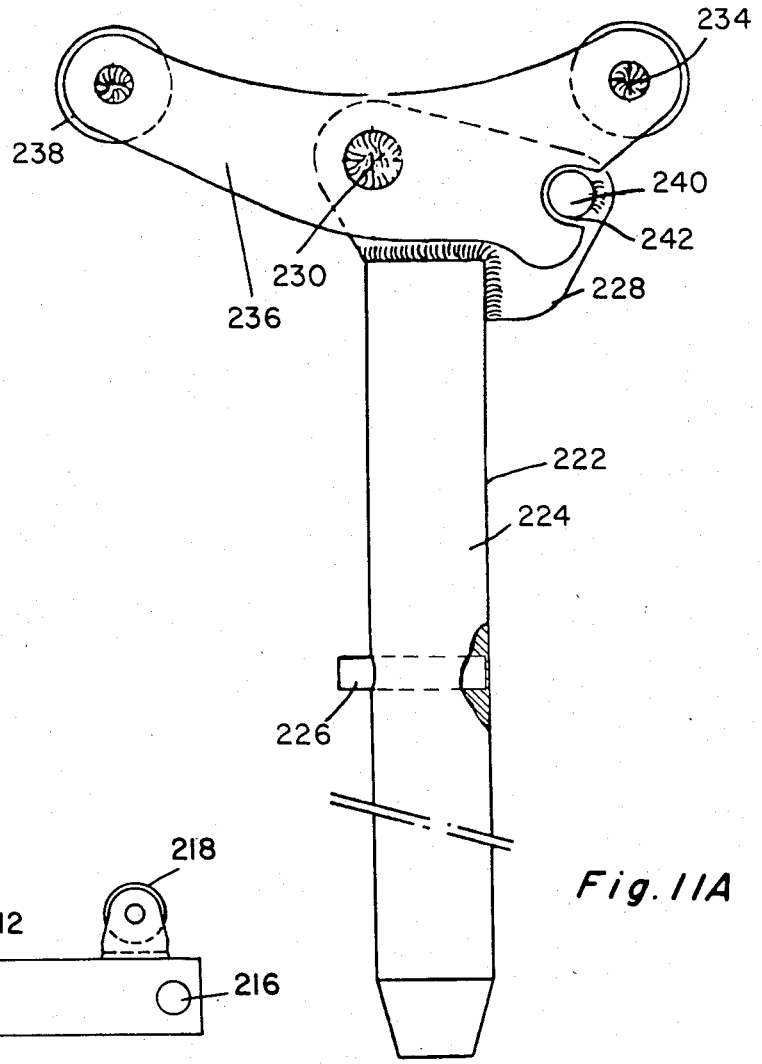
FIGS. 11A and 11B are illustrations of a selectably positionable ordnance support constructed and operative in accordance with the present invention.
Figure 11B:
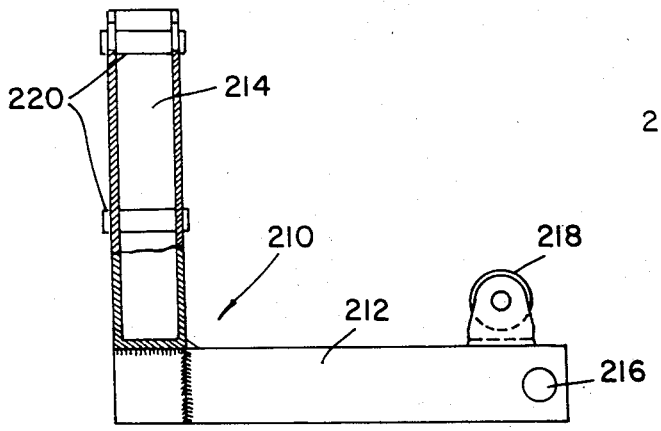

Reference is now made to FIGS. 11A and 11B which illustrate selectably positionable ordnance support apparatus constructed and operative in accordance with an embodiment of the present invention and comprising a plurality of ordnance support brackets 210 which are selectably positionable along the length and width of the load support frame 140.

Ordnance support brackets are employed in pairs, normally to support a cluster of bombs onto the load support frame by engaging the bomb surfaces. It is a particular feature of the present invention that the separation between elements of a pair of brackets 210 may be determined as may the separation between adjacent pairs of brackets.

Brackets 210 typically comprise a base portion 212 and an upstanding portion 214. Base portion 212 is configured to be selectably seated on a track or in a recess formed in load support frame 140 at a selectable position and is formed with a locating aperture 216 for receiving a securing pin for determining its position. A roller 218 is provided on the top surface of base portion 212 for supporting a bomb surface.

Upstanding portion 214 comprises a generally hollow shaft having a pair of support pins 220 for supporting a selectably positionable ordnance support arm 222, illustrated in FIG. 11A. Support arm 222 comprises a shaft 224 having a transverse support pin 226 formed therein and terminating at a top end thereof in a pivot axis defining portion 228 defining a pivot axis 230. Pivotably mounted onto portion 228 at axis 230 is a roller support portion 236 which supports a pair of rollers 234 and 238. It is a particular feature of the present invention that a predetermined amount of play is permitted between members 228 and 236 and thus in the positioning of rollers 234 and 238. The amount of play is determined by the interaction between a stop pin 240 mounted on portion 228 and a socket 242 defined in member 236 and which is broader than the diameter of the pin 240 by a predetermined amount.

In operation support arm 222 is disposed within upstanding portion 214 such that support pin 226 is supported on one of support pins 220 defined therein at predetermined height. It is a particular feature of the construction of the ordnance support apparatus that rotation of the support arm 222 by 90 degrees causes pin 226 to disengage with pins 220 and allows support arm 222 to fully retract within upstanding portion 214.

The selectable positionability and quick retraction features described hereinabove are particularly important in ordnance loading on aircraft since they enable quick disengagement of the loading apparatus from the aircraft after ordnance loading.

Figure 12:
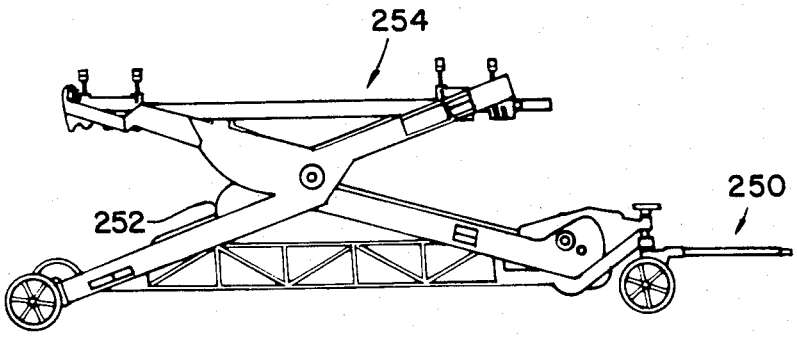
FIG. 12 is a pictorial illustration of an alternative embodiment of lifting apparatus constructed and operative in accordance with an embodiment of the present invention.

Reference is now made to FIG. 12 which is a pictorial illustration of loading apparatus constructed and operative in accordance with an alternative embodiment of the invention and including many of the features described hereinabove. In the illustrated embodiment, the loading apparatus comprises a single foward steering wheel assembly 250 and no castor assembly. A further important feature of this embodiment is that it employs only a single cam disk 252 in engagement with one of the two scissors assemblies 254 which are provided. The two sicssor assemblies are strongly attached to each other such that common motion thereof is provided. The embodiment of FIG. 12 is generally smaller than the embodiment of FIGS. 1A and 1B but may be of any suitable size.

Figure 13:
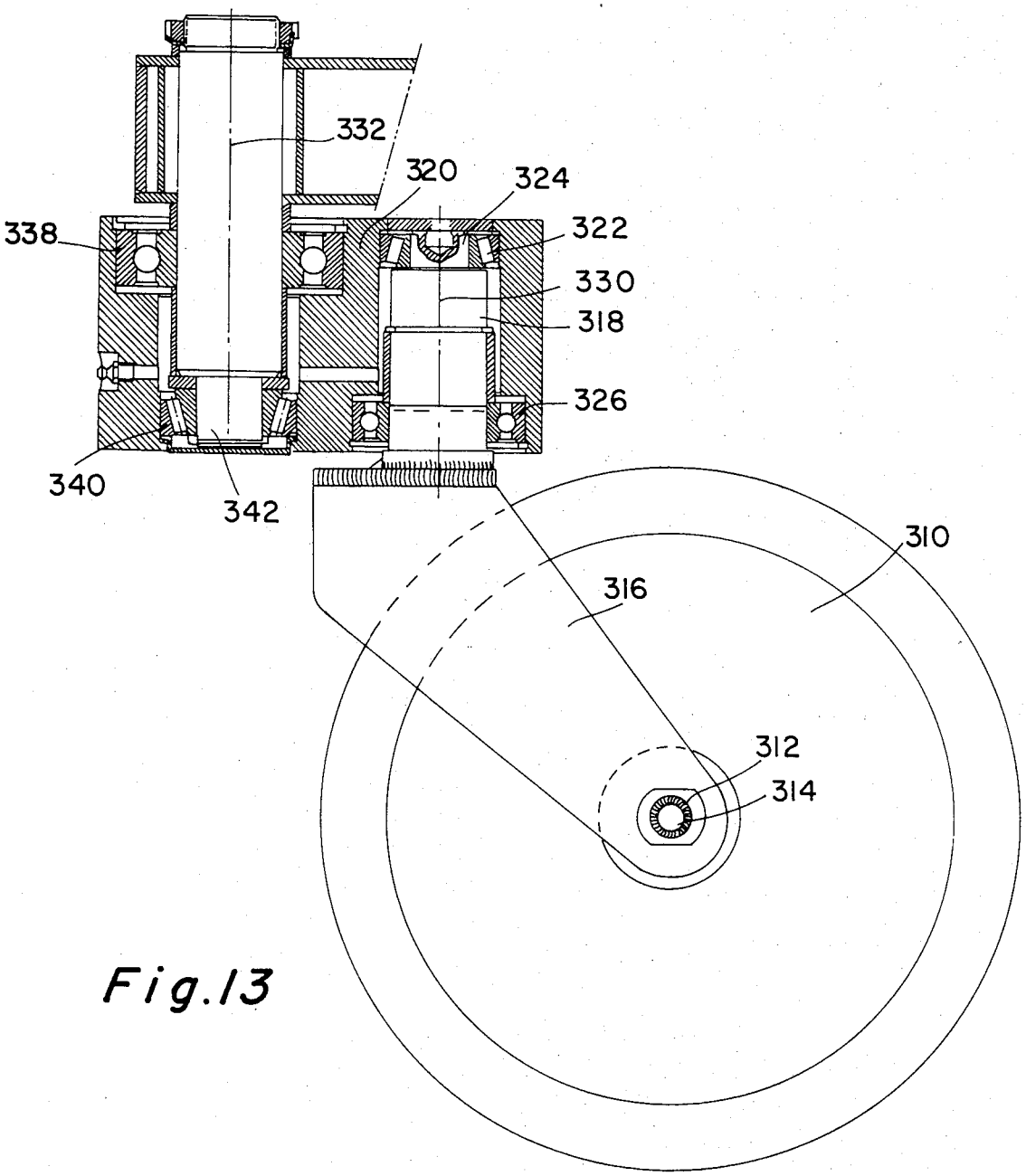
FIG. 13 is a side view sectional illustration of a castor assembly constructed and operative in accordance with a preferred embodiment of the present invention.

Reference is now made to FIG. 13 which illustrates a caster assembly constructed and operative in accordance with a preferred embodiment of the present invention and comprising a castor wheel 310 of conventional construction which is rotatably mounted as by a bearing mounting 312 onto an axle 314. Axle 314 is supported in a generally horizontal orientation by a sprocket 316 which is fixedly attached at the upper portion thereof to a generally vertical pivot axle 318. Pivot axle 318 is rotatably mounted in a pivotable support assembly 320 by means of a pair of bearings including a tapered roller bearing 322 engaging a narrowed top portion 324 of axle 318 and a straight ball bearing 326 located adjacent a relatively broader lower portion of axle 318.

It is appreciated that the particular bearing mounting employed in the embodiment of FIG. 13 is designed to provide a high load capacity and resistance to torque generated by the offset mounting of the castor. Any suitable alternative low friction mounting having the required load capacity may be employed alternatively.

Pivot axle 318 is disposed along an axis 330 defined in pivotable support assembly 320. Disposed along an axis 332 defined in support assembly 320 and offset from axis 330 is a pivot axle 334 which is fixedly coupled to the chassis of a trolley or other vehicle, here indicated by reference numeral 336. Pivot axle 334 is mounted in support assembly 320 for low friction rotatability by means of a high capacity ball bearing 338 which engages an intermediate portion of the axle 334 and by a tapered roller bearing 340 which engages a narrowed lower portion 342 of axle 334.

It is a particular feature of the castor assembly described above that due to its mutually offset two axle construction, it is extremely easy to maneuver and avoids the problem of castor locking which is often encountered in conventional castors when the applied force lies perpendicular to the plane of the castor wheel. Because of the absence of a force connection between the pivot axle 318 and the chassis along axis 330, as in the prior art castors of this type, the frictional resistance to rotational movement is greatly decreased as compared with the prior art. As a result, the castor assembly shown in FIG. 13 can be moved as desired with a very small force, even when subject to large loads.

According to a preferred embodiment of the invention, the separation distance between axes 330 and 332 in the support assembly 320 is selected to have a predetermined relationship with the overall diameter of the castor wheel 310 whereby the force required to produce rotation of the castor wheel 310 is reduced to an empirical minimum. In the illustrated embodiment the distance between axes 330 and 332 is equal to about 30% of the diameter of the castor wheel 310.

Figure 14A:
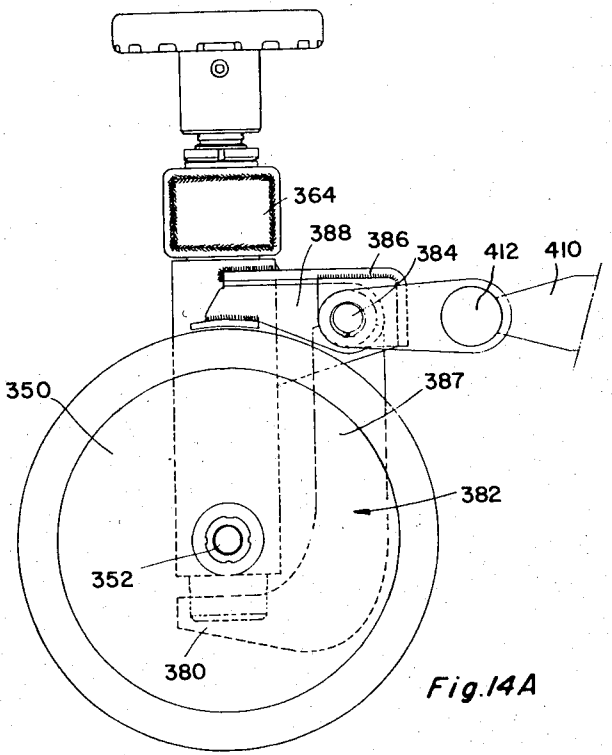
FIG. 14A is a side view illustration of a steering wheel constructed and operative in accordance with an embodiment of the present invention.

Reference is now made to FIGS. 14A and 14A which illustrate a steering wheel constructed and operative in accordance with an embodiment of the present invention and comprising a castor wheel 350 which is bearing mounted onto a generally horizontal axle 352. Axle 352 is supported on a generally vertical support shaft 354 and has a stepwise decreasing radius as it extends outwardly from shaft 354. A first ball bearing 356 engages a near side of wheel 350 and a relatively large diameter region 357 of axle 352, and a second ball bearing 358 engages a far side of wheel 350 and a relatively small diameter outer region 360 of axle 352. This arrangement provides a high load capacity and resistance to bending moments.

Verticle support shaft 354 is rotatably mounted onto a fixed support shaft 362 which is fixedly mounted onto a vehicle chassis 364. Fixed support shaft 362 is formed with a central bore 366 which permits axial movement of a brake actuating shaft 368 therethrough. The mounting of shaft 354 onto shaft 362 comprises a collar 369 at the top portion thereof and a tapered bearing 370 adjacent the bottom thereof.

Fixedly attached to the bottom portion of verticle support shaft 354 is an end member 372. Bearing 370 engages member 372 and an intermediate bore member 374 which is fixedly attached to the bottom of shaft 362.

A brake actuating knob 376 is threadably mounted onto fixed support shaft 62 and defines an underneath surface 378 which engages a top surface of brake actuating shaft 368. It may be appreciated that the position of knob 376 determines the amount by which brake actuating shaft 368 protrudes from intermediate member 374 into end member 372.

The bottom of brake engaging shaft 368 engages a bottom portion 380 of a brake lever member 382 which is pivotably mounted about a pivot axis 384 defined on a side protruding member 386 which is fixed to shaft 354. Brake lever member 382 also defines an intermediate portion 387 which connects bottom portion 380 with pivot axis 384, and a top portion 388 which extends forward and to the side so as to overlie wheel 350. Top portion 388 terminates in a curved friction plate 390 which is arranged for selectable braking engagement with the peripheral surface of wheel 350.

The operation of the brake assembly may be summarized as follows: Rotation of the brake actuating knob 376 in a predetermined direction causes the surface 378 thereof to move downwardly relative to shaft 362 and thereby to force brake actuating shaft 368 downwardly in bore 366. The downward motion of shaft 368 forces bottom portion 380 of lever 382 downwardly causing it to pivot about axis 384 and to bring friction plate 390 into braking engagement with wheel 350, thus preventing rotation thereof. Release of the brake is produced by opposite rotation of knob 376. It is noted that the lever 382 is constructed such that when knob 376 is in its raised orientation, the friction plate 390 is disposed out of engagement with wheel 350.

It is a particular feature of the present invention that the braking action is realized without interfering with the rotatability of the wheel about a vertical axis by permitting relative rotation between the lever 382, which rotates together with the wheel 350, and the brake actuating shaft 368, which remains stationary with respect to that rotation. A steering and pull/push handle 410 is pivotably connected via a pivot axle 412 to side protruding member 386 for enabling movement of the trolley upon which the steering wheel assembly is mounted.

Figure 14B:
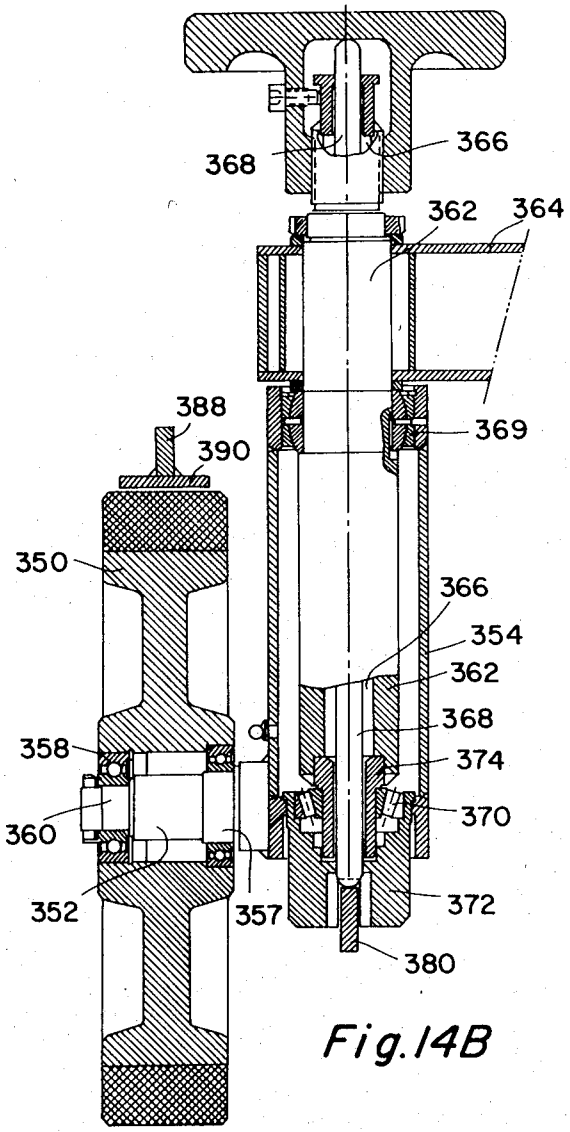
FIG. 14B is a sectional illustration of the steering wheel of FIG. 14A taken along the plane B—B.

Reference is now made to FIG. 3 which is an illustration of a trolley constructed and operative in accordance with an embodiment of the present invention and which comprises a chassis 10 which is supported on a total of four wheels. The rear of chassis 10 is supported on an axle 56 onto the ends of which are mounted first and second wheels 54. At the left front corner of chassis 10 there is provided a caster assembly 22 as described hereinabove in connection with FIG. 13. At the right front corner of chassis 10 there is provided a steering wheel assembly 20 as described hereinabove in connection with FIGS. 14A and 14B.

It is a particular feature of the present invention that steering and movement of the trolley is provided at one corner thereof. This is made possible by the provision of castor assembly 22. Another important feature of the present invention is the provision of a large range of motion for the steering wheel assembly 20. The range of motion is at least 180° of arc and preferably approximately 270° of arc. This large range of motion coupled with the highly responsive operation of the castor assembly 22 provides the trolley with a degree of maneuverability unknown in the prior art. According to a preferred embodiment of the invention, the trolley can be turned by 360° nearly within a diameter approximately equal to the distance between axle 56 and either of the front wheels. This turning can be accomplished entirely by one kind of applied force, i.e. either by pushing or pulling. Due to the ease of operation of the trolley, such motion may be produced by unaided human force, even when the trolley is heavily loaded.

It will be appreciated by persons skilled in the art that the invention is not limited to what has been particularly shown and described hereinabove. Rather the scope of the invention is defined only by the claims which follow.

I claim:

1. Lifting apparatus comprising:

at least one scissors mechanism including:

a pair of scissor arms, at least one of said scissor arms having formed thereon a curved cam path; and a cam disposed between said pair of scissor arms for engagement therewith and selectable separtion thereof for producing lifting operation of said scissors mechanism; and load support means mounted onto said scissor arms for selectable positioning thereof; and cable apparatus operative for producing selectable motion of said cams and comprising:

crank means;

a first winding reel operated by said crank means for winding a cable attached thereto;

a primary cable attached to said first winding reel for being selectably wound thereby;

first and second selectably positionable pulleys which are engaged by said primary cable for selectable positioning thereof; and first and second secondary cables coupled to said respective first and second selectably positionable pulleys at a first end and engaging respective first and second ones of said cams for selectable positioning thereof in accordance with the positioning of said first and second selectably positionable pulleys;

wherein said curved cam path is configured such that a generally constant amount of force is required at all stages of separation of said scissor arms from a fully retracted to a fully raised orientation thereof.

2. Lifting apparatus comprising:

a pair of scissors mechanisms each including:

a pair of scissor arms;

a cam disposed between said pair of scissor arms for engagement therewith and selectable separation thereof for producing lifting operation of said scissors mechanism;

load support means mounted onto said scissor arms for selectable positioning thereof; and cable apparatus operative for producing selectable motion of said cams and comprising:

crank means;

a first winding reel operated by said crank means for winding a cable attached thereto;

a primary cable attached to said first winding reel for being selectably wound thereby;

first and second selectably positionable pulleys which are engaged by said primary cable for selectable positioning thereof; and first and second secondary cables coupled to said respective first and second selectably positionable pulleys at a first end and engaging respective first and second ones of said cams for selectable positioning thereof in accordance with the positioning of said first and second selectably positionable pulleys.

3. Lifting apparatus according to claim 2 and wherein said cable apparatus comprises crank means which may be alternatively operated by human power or by a portable power assisted rotating drive mechanism.

4. Lifting apparatus according to claim 2 and wherein said primary cable extends from said first winding reel into engagement with said first selectably positionable pulley, around a pair of fixed corner pulleys, into engagement with said second selectably positionable pulley and to a fixed location, whereby winding of said primary cable onto said first winding reel provides forward motion of said first and second selectably positionable pulleys.

5. Lifting apparatus according to either of claims 2 and 4 and wherein said first and second selectably positionable pulleys are located each within a respective scissor arm of a different scissor mechanism.

6. Lifting apparatus comprising:

at least one scissors mechanism including:

a pair of scissor arms; and a cam disposed between said pair of scissor arms for engagement therewith and selectable separation thereof for producing lifting operation of said scissors mechanism;

said cam being constructed for simultaneous rolling engagement with both of said scissor arms and comprising a central hub, a central disk bearing mounted onto said hub and defining a channel for receiving a driving cable, an inner disk member, and a bifurcated outer disk member which is fixed onto said hub, said inner and outer disk members being arranged to permit relative rotation therebetween.

7. Lifting apparatus according to claim 6 and wherein:

said central disk rollingly engages a first one of said scissor arms and said outer disk engages a second one of said scissor arms;

said second one of said scissor arms defines a cam path;

said cam path being curved so as to define a configuration whereby a generally constant amount of force is required to move said cam therealong, producing lifting action of said scissors mechanism along substantially its entire range of lifting motion;

and wherein said first one of said scissor arms defines a channel dimensioned such that engagement between said cam and said channel is along a bottom surface thereof.

8. Lifting apparatus according to claim 7 and wherein said second one of said scissor arms defines a channel dimensioned such that the cam path is defined by a top surface thereof.

9. Lifting apparatus according to claim 2 and wherein said channel of said second one of said scissor arms is configured so as to define a seating enclosure for a portion of said cam rearwardly of said cam path for permitting extremely low profile retraction of said scissors mechanism when in a fully lowered orientation.

* * * * *